US010539312B2

(12) United States Patent
Bernstein

(10) Patent No.: US 10,539,312 B2
(45) Date of Patent: Jan. 21, 2020

(54) ENHANCING VISIBILITY

(71) Applicant: Visijax Limited, Stoney Stanton, Leicestershire (GB)

(72) Inventor: Mark Jonathan Bernstein, Stoney Stanton (GB)

(73) Assignee: Wearable Technology Limited, Stoney Stanton, Leicestershire (GB)

( * ) Notice: Subject to any disclaimer, the term of this patent is extended or adjusted under 35 U.S.C. 154(b) by 203 days.

(21) Appl. No.: 14/561,298

(22) Filed: Dec. 5, 2014

(65) Prior Publication Data

US 2015/0176825 A1 Jun. 25, 2015

(30) Foreign Application Priority Data

Dec. 24, 2013 (GB) ..... 1323058.6

(51) Int. Cl.
*F21V 33/00* (2006.01)
*F21V 23/04* (2006.01)
(Continued)

(52) U.S. Cl.
CPC ..... *F21V 23/0471* (2013.01); *F21L 4/08* (2013.01); *F21V 23/001* (2013.01); *F21V 23/0407* (2013.01); *F21V 33/0008* (2013.01); *A41B 1/08* (2013.01); *A41D 1/02* (2013.01); *A41D 1/04* (2013.01); *A41D 19/0024* (2013.01); *F21W 2111/10* (2013.01); *Y10T 29/49002* (2015.01)

(58) Field of Classification Search
CPC . A41D 1/04; A41D 1/02; A41D 1/002; A41D 19/0024; A41B 1/08; F21V 23/0407; F21V 23/0471; F21V 33/0004; F21V 33/0008; F21W 2111/10; F21Y 2115/10
USPC ..... 362/103
See application file for complete search history.

(56) References Cited

U.S. PATENT DOCUMENTS 4,839,777 A * 6/1989 Janko ..... A41D 27/085 362/103
5,070,436 A * 12/1991 Alexander ..... A41D 13/01 340/321
(Continued)

FOREIGN PATENT DOCUMENTS

GB 2319164 A 5/1998
GB 2417186 A 2/2006
(Continued)

OTHER PUBLICATIONS

English Machine Translation of WO 2005/034663 provided by ESPACENET.*

*Primary Examiner* — Zheng Song
(74) *Attorney, Agent, or Firm* — James Creighton Wray

(57) ABSTRACT

An item of clothing in the form of a jacket provides enhanced visibility for a cyclist. A right detection device is configured to identify a raising of a right arm and a right indictor light (103) is configured to indicate in response to the raising of the right arm. Similarly, a left detection device is configured to identify the raising of a left arm and a left indicator light 104 is configured to indicate in response to the raising of the left arm. A housing contains a power supply and a control circuit and a pocket is provided in the jacket for supporting the housing. Wires extend from the housing to the detection devices and indicators and these wires are restrained within seams used to construct the jacket.

10 Claims, 12 Drawing Sheets

(51) Int. Cl.

| | |
|---|---|
| ***F21V 23/00*** | (2015.01) |
| ***F21L 4/08*** | (2006.01) |
| *A41D 1/04* | (2006.01) |
| *A41D 1/02* | (2006.01) |
| *A41D 19/00* | (2006.01) |
| *A41B 1/08* | (2006.01) |
| *F21W 111/10* | (2006.01) |

(56) References Cited

U.S. PATENT DOCUMENTS 5,690,411 A * 11/1997 Jackman ..... G08B 5/006 362/103
6,834,395 B2 * 12/2004 Fuentes ..... A41D 13/01 2/69
6,964,493 B1 11/2005 Whitlock
7,077,538 B2 * 7/2006 Wooldridge ..... A41D 13/01 362/103
9,470,411 B1 * 10/2016 Ramsey ..... A41B 9/00
2002/0044052 A1 * 4/2002 Stewart ..... A41D 13/01 340/475
2003/0182705 A1 * 10/2003 Spongberg ..... A41D 1/00 2/69
2006/0082987 A1 * 4/2006 Dorsey ..... F21V 23/04 362/103
2006/0291193 A1 * 12/2006 Hill ..... A41D 13/01 362/108
2008/0043458 A1 * 2/2008 Desjardin ..... A41D 13/01 362/108
2008/0089056 A1 * 4/2008 Grosjean ..... B60Q 1/2673 362/103
2010/0251453 A1 10/2010 Chen
2010/0253501 A1 * 10/2010 Gibson ..... A41D 13/01 340/475
2011/0102304 A1 * 5/2011 Nelson ..... G09G 3/00 345/46
2011/0235311 A1 * 9/2011 Stone ..... A41D 13/01 362/106
2013/0077289 A1 * 3/2013 Gridley ..... A41D 27/085 362/103
2014/0254143 A1 * 9/2014 Wansor ..... F21V 33/0008 362/103
2014/0268685 A1 * 9/2014 McLisky ..... A41D 13/01 362/108
2014/0376209 A1 * 12/2014 Leung ..... F21V 33/0008 362/103

FOREIGN PATENT DOCUMENTS

GB 2477822 A 8/2011
GB 2494917 A 3/2013
WO WO2005/034663 * 4/2005 ..... A41D 13/01

* cited by examiner

ENHANCING VISIBILITY

CROSS REFERENCE TO RELATED APPLICATIONS

This application claims priority from United Kingdom Patent Application No. 13 23 058.6 filed 24 Dec. 2013, the entire disclosure of which is incorporated herein by reference in its entirety.

BACKGROUND OF THE INVENTION

1. Field of the Invention

The present invention relates to a wearable item for enhancing visibility.

The present invention also relates to a method of fabricating an item of clothing for enhancing the visibility of a user.

2. Description of the Related Art

It is known to provide apparatus for enhancing the visibility of a user, such as a cyclist. Items may be attached to the cyclist personally or items, such as lights, may be attached to the bicycle.

It is generally accepted that motorists pose the biggest danger to cyclists, particularly on busy roads. Problems exist in terms of making a cyclist and other road users visible.

BRIEF SUMMARY OF THE INVENTION

According to an aspect of the present invention, there is provided a A wearable item for enhancing visibility, comprising: a plurality of material elements connected by stitched seams; at least one illuminating device which is activated in response to detecting a movement; a source of electrical power; and an electrical conductor for conducting electrical power from said source of electrical power to said illuminating device; wherein a substantial proportion of said electrical conductor is secured within said seams.

In an embodiment, the item is configured substantially as a jacket. In an embodiment, the movement is instigated to indicate an intention to turn.

According to a second aspect of the present invention, there is provided a method of fabricating an item of clothing for enhancing the visibility of a user, comprising the steps of: constructing an illumination system, comprising a right detection device, a left detection device, a right indicator device, a left indicator device, a housing and electrical conductors connecting said housing to said indicator devices; assembling material components, wherein said material components are configured to be joined together by stitches forming a plurality of seams; and securing a least a portion of said electrical conductors within said seams.

In an embodiment, a delay circuit is added configured to maintain the activation of at least one of the indicating devices for a period of time after detecting a movement and means may be added for causing the any one of the indicating devices to flash periodically.

DETAILED DESCRIPTION OF EXAMPLE EMBODIMENTS

FIG. 1

Figure 1:
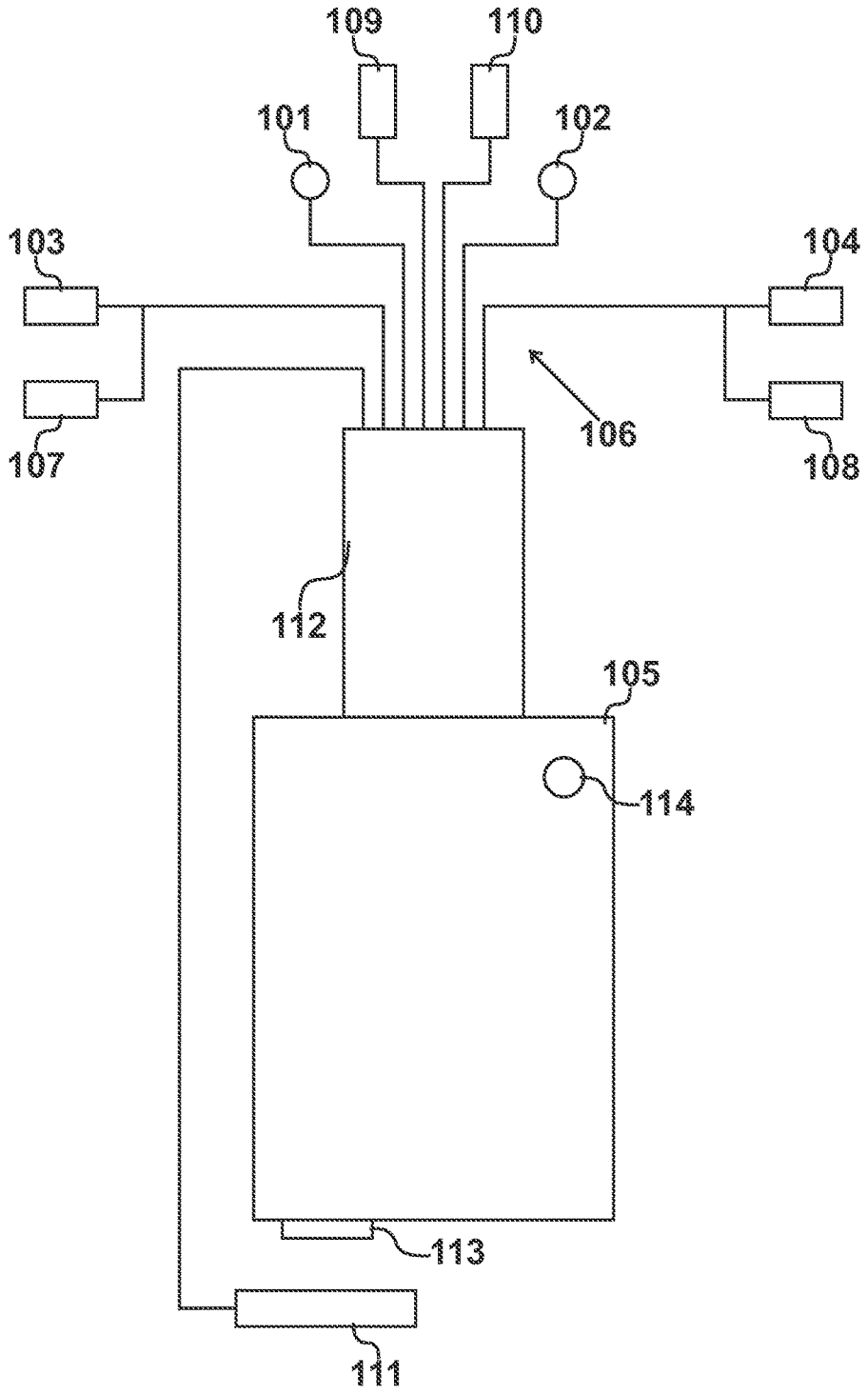
FIG. 1 shows an illumination system.

An illumination system is illustrated in FIG. 1 that has been constructed with a right detection device 101, a left detection device 102, a right indicator device 103, a left indicator device 104, a housing 105 and a wiring loom 106. The wiring loom connects the housing 105 to the indicator devices 103, 104 and to the detection devices 101, 102.

The illumination system of FIG. 1 is shown as a front view such that, from the perspective of the user, detection device 101 would be on the user's left; but actually shown to the right in FIG. 1.

In use, the raising of a cyclists right arm is detected by detection device 101, possibly taking the form of rocker switch, thereby closing a circuit, such that it is possible for this condition to be detected by circuitry contained within the housing 105. The circuitry will then energize indicating device 103 such that indicating device 103 is seen to flash. In an embodiment, indicating device 103 includes one or more amber colored light emitting diode (LED) devices. Thus, upon raising a right arm, indicator 103 is caused to flash in a way that would be recognizable to a motorist as an indication to the effect that the cyclist intends to turn right.

In an embodiment, a second right indicator 107 is provided, such that the first indicator 103 may be positioned to the front of the jacket and the second indicator 107 may be positioned on the back of the jacket.

Thus, left indicator 104 may be positioned on the front of a jacket, with a second left indictor 108 being positioned on the back of the jacket. Thus, in response to detection device 102 detecting that the left arm has been raised, both LEDs 104 and 108 will be energized such that amber flashes are seen on the left side of the cyclist.

In an embodiment, to improve overall visibility, a first permanent front LED array 109 is provided along with a second permanently lit front array 110.

A permanently lit rear array 111 is also provided, preferably including a plurality of red LED devices.

In an embodiment, the loom 106 is connected to the housing 105 by a detachable plug 112 that may be attached to and then detached from an appropriately configured socket within housing 105.

In addition to housing a control circuit, the housing also contains a battery of energizing cells. These cells may take the form of replaceable cells or they make take the form of rechargeable cells. In the embodiment of FIG. 1, rechargeable cells are included that are recharged via a recharge socket 113. In an embodiment, recharge socket 113 takes the form of a conventional mobile device charging port, such as a USB socket. In this way, it is possible for the rechargeable cells to be recharged using readily available recharging equipment, as used for the charging of other mobile devices such as mobile cellular telephones.

In an embodiment, a toggle button 114 is included for energizing and de-energizing the device manually.

FIG. 2

Figure 2:
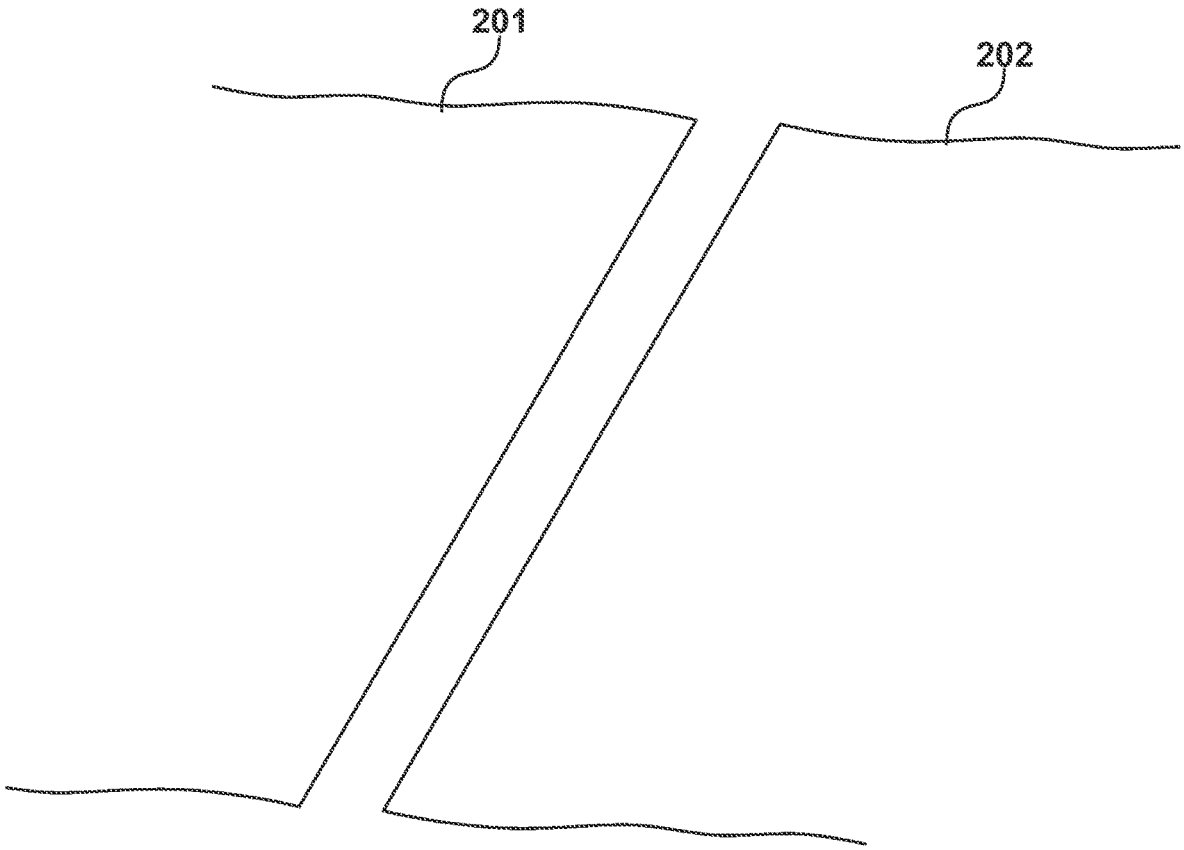
FIG. 2 illustrates a first stage in an assembly process.
Figure 3:
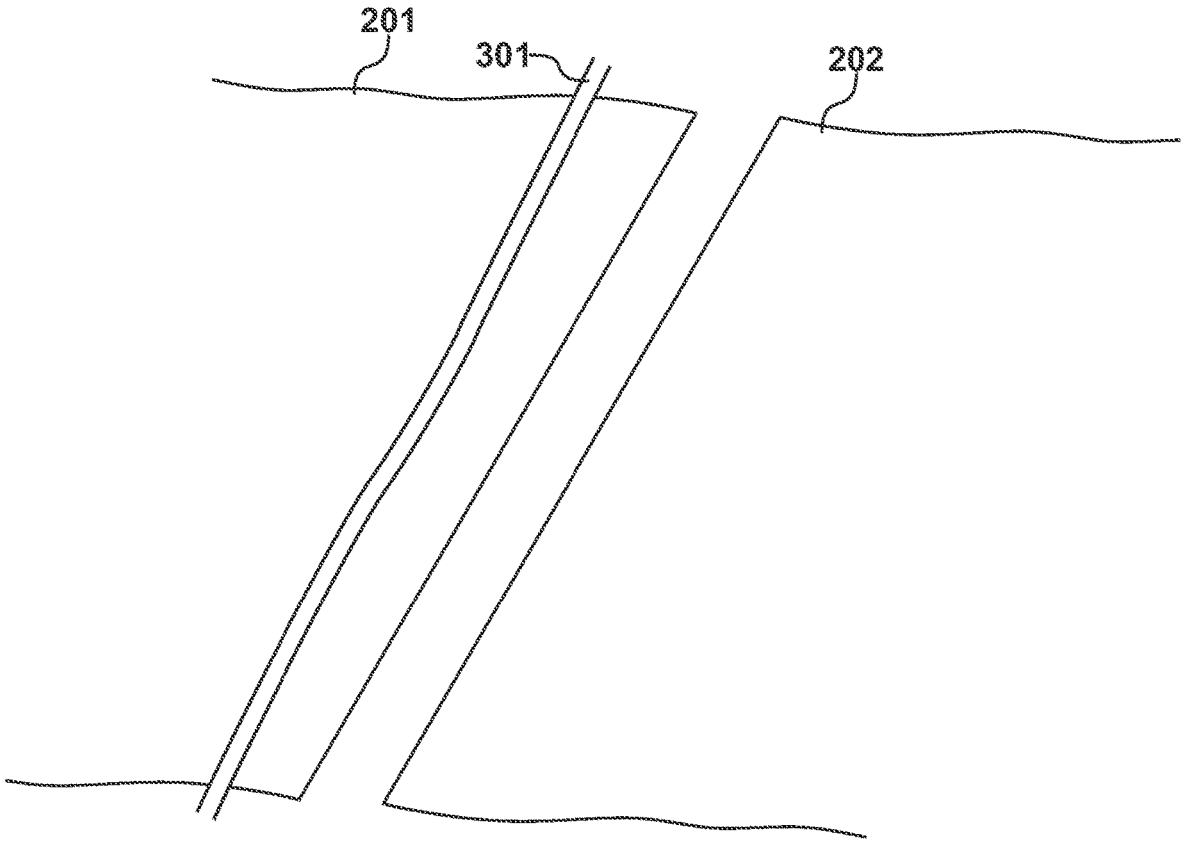
FIG. 3 shows a second stage of said assembly process.

In an embodiment, the item of clothing is assembled from material components. As illustrated in FIG. 2, this includes a first material component 201 and a second material component 202. These are configured to be joined together by stitches thereby forming a seam. To construct the jacket, many seams of this type are required. Given that several layers of material are included at the seams, the seams represent a relatively strong region of the jacket, less susceptible to being strained in response to stresses applied thereto during the use of the jacket whilst cycling.

It has been appreciated that wiring loom 106 may become damaged or detached if care is not taken to ensure that the loom is secured to the jacket. Thus, in accordance with the present invention, at least a portion of the wiring loom is secured to the item within one or more of these seams.

FIG. 3

Having positioned component 201 in place, alongside material component 202, a portion 301 of the wiring loom 106 is placed over material component 201. In this embodiment, the component 301 is held in place exclusively by the stitching used to connect the individual material components.

FIG. 4

Having located section 301 over material component 201, material component 202 is then laid over the combination to provide a region of overlap, indicated by region 401.

Figure 4:
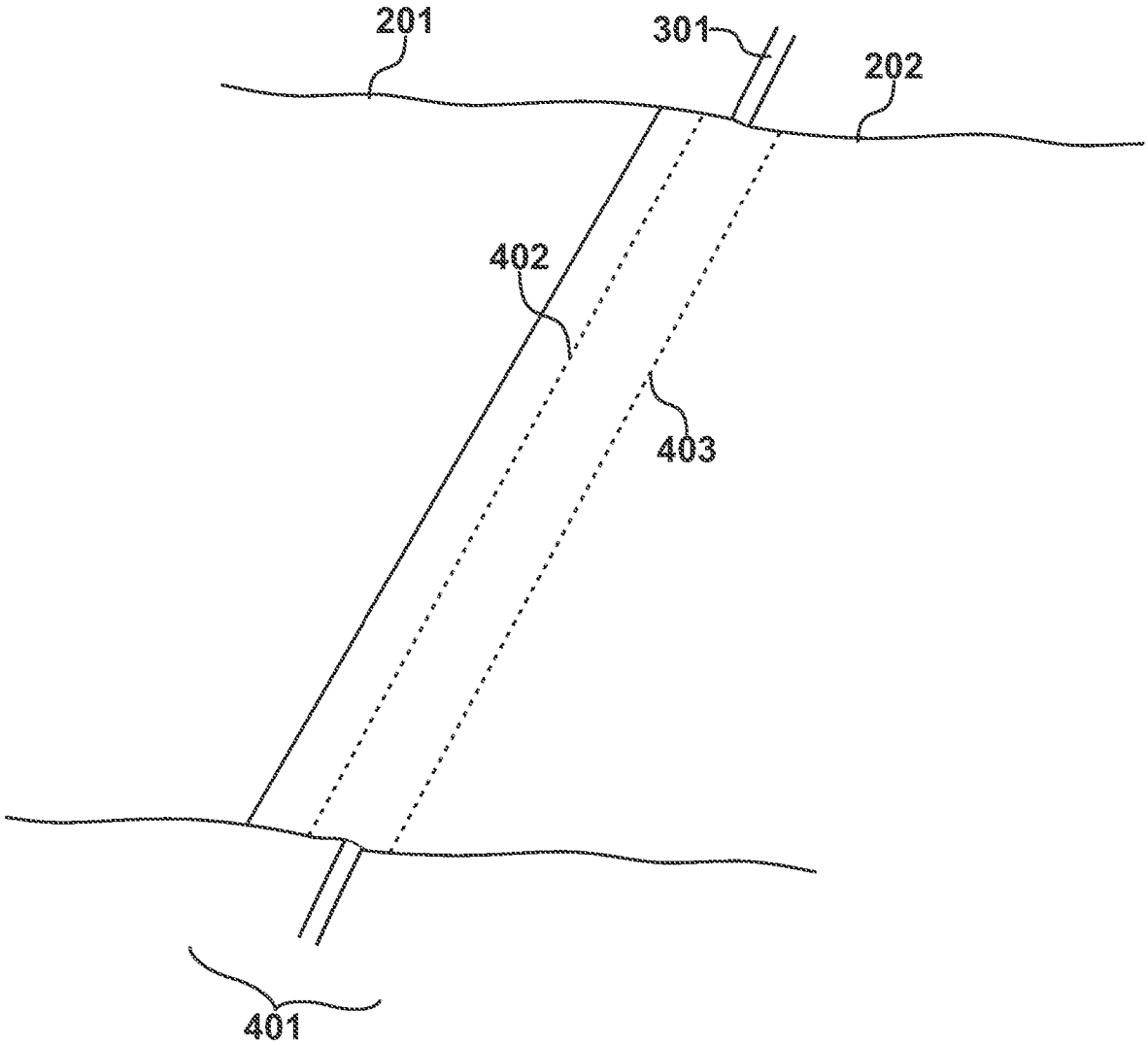
FIG. 4 shows a third stage of the assembly process.
Figure 5:
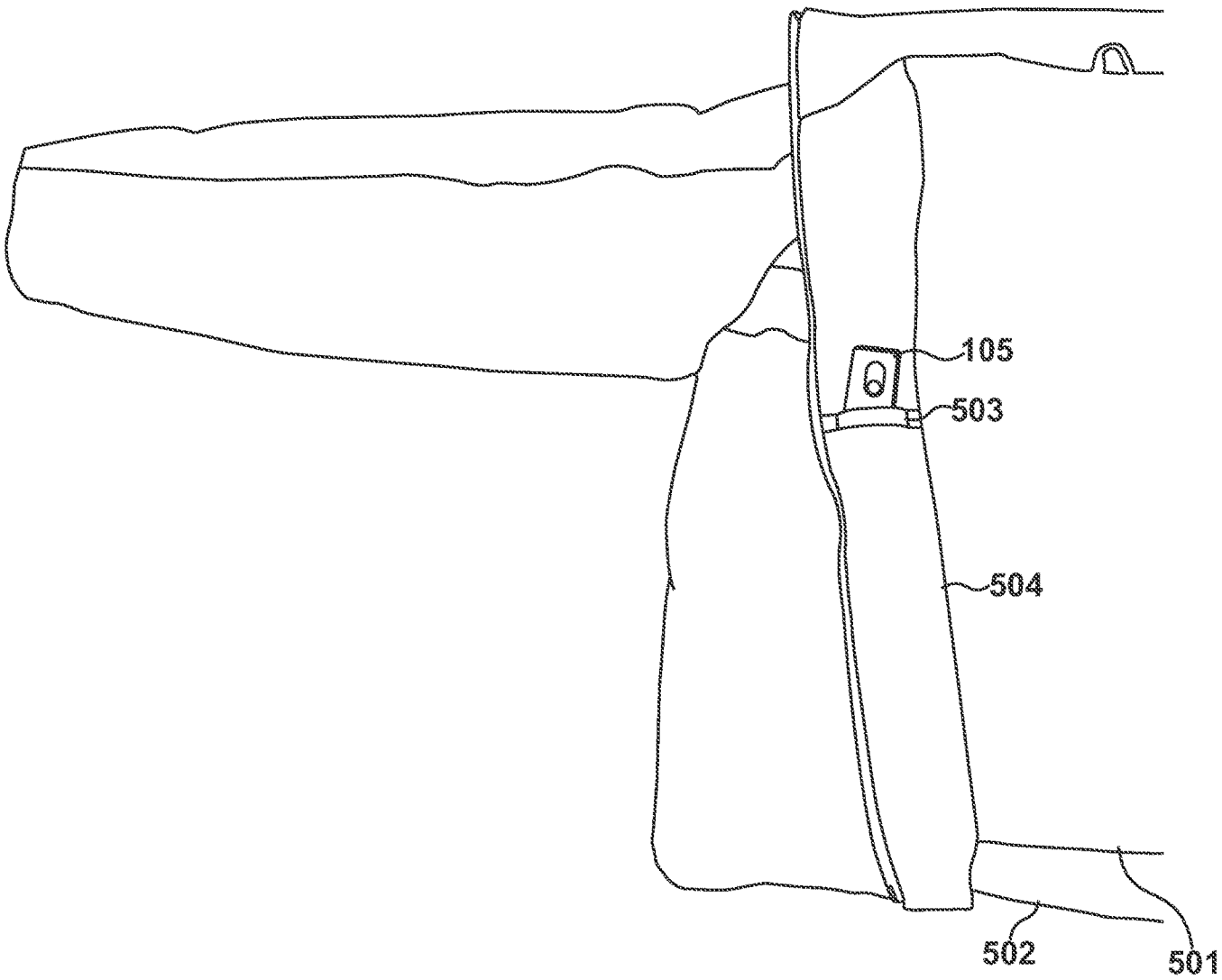
FIG. 5 illustrates the construction of a jacket.

A seam is then formed so as to hold material component 201 securely to material component 202 by a first row of stitches 402 and a second row of stitches 403. As shown in FIG. 4, the loom section 301 is held securely between said first row of stitches 402 and said second row of stitches 403. The example shown in FIG. 4 may be considered as a plain seam. In an alternative approach, a French seam is deployed, so that raw edges of the material are fully enclosed.

Thus, in accordance with the invention, the conductor is a wire secured substantially within the seams.

FIG. 5

In an embodiment, the item of clothing takes the form of a jacket. Furthermore, in an embodiment, the jacket is constructed from a plurality of layers. Thus, an internal layer, of, for example, a mesh material 501 may be attached to the external layer 502, possibly, for example, using high visibility fluorescent material, thereby increasing the visibility of the jacket during the daytime.

In an embodiment, the housing 105 is detachable so as to allow the housing to be removed. In an embodiment, the connectors are water resistant, such that is should be possible to remove the housing and thereafter allow the jacket to be washed using conventional washing techniques.

In use, housing 105 may be restrained within a pocket 503 constructed within an internal surface 504 of the jacket.

FIG. 6

Having located the loom 106 within the jacket such that, wherever possible, the wiring loom is secured within seams forming the jacket, it is necessary to connect the detecting devices 101, 102 and the indicating devices 103, 104 etc.

Figure 6:
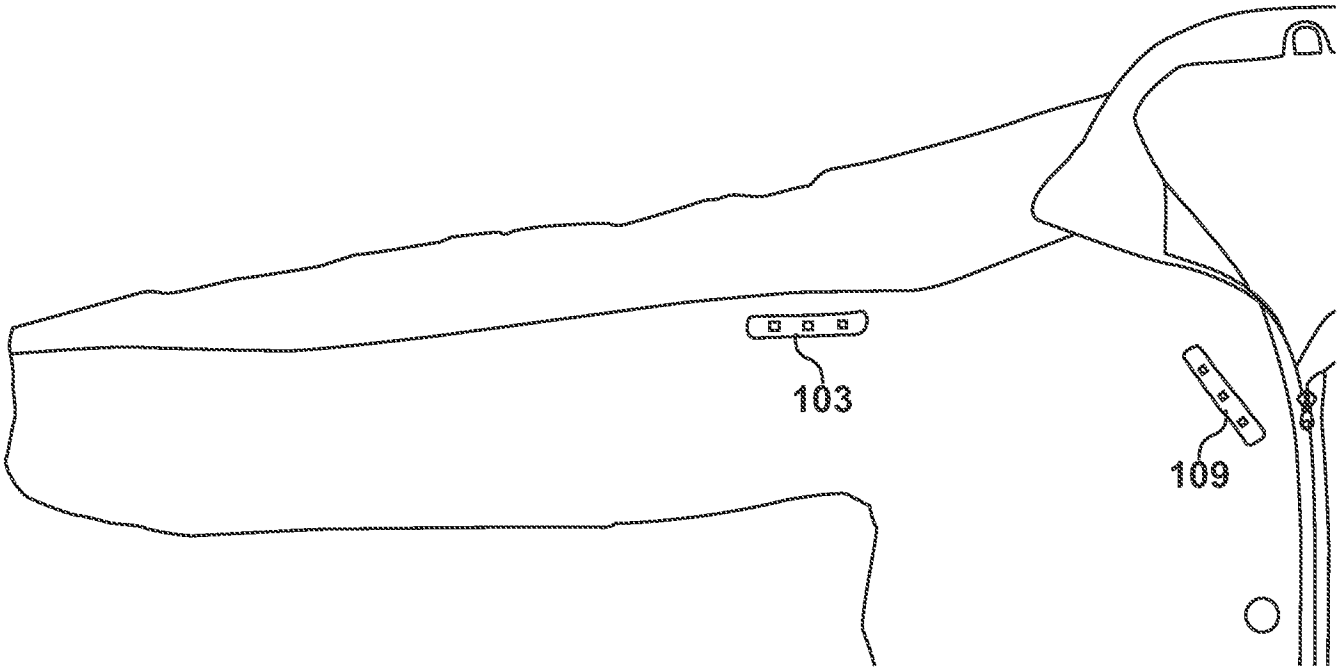
FIG. 6 illustrates the application of indicators.

As shown in FIG. 6, indicating device 103 is located on the front upper arm of the jacket. Indicator device 109 is located towards the collar of the jacket.

In this embodiment, each indicator device includes three LED devices configured to emit amber light when energized. Thus, in response to detector 101 detecting that the right arm has been raised, indicator 103 will be energized periodically in order to create a flashing amber light. A similar device, device 107, is provided to the rear of the right arm.

In an embodiment, LED device 109 is configured to emit white light and remains constantly energized to illuminate the cyclist.

FIG. 7

Figure 7:
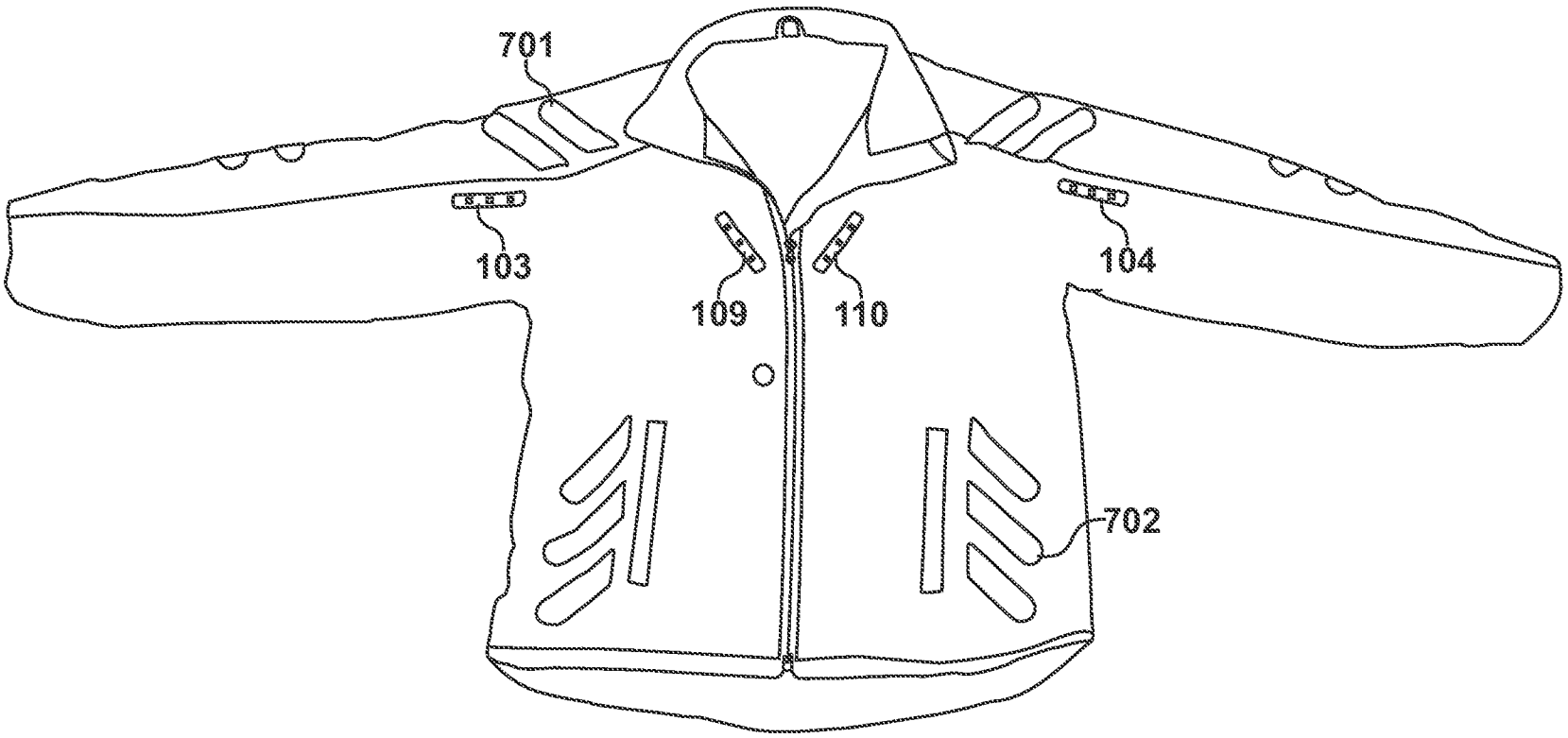
FIG. 7 shows further items added to a jacket.

Indicating device 103 and illuminating device 109 are also shown in FIG. 7. FIG. 7 shows the full jacket and therefore includes indicating device 104 and illuminating device 110. Each of these devices has been attached to the jacket and in an embodiment, the devices comprise a plurality of light emitting diodes.

In this embodiment, reflective materials 701 have been added to the arms and similar reflective materials 702 have been added to the torso. These reflective materials 701, 702 improve night time visibility and may include retro-reflective materials.

FIG. 8

Figure 8:
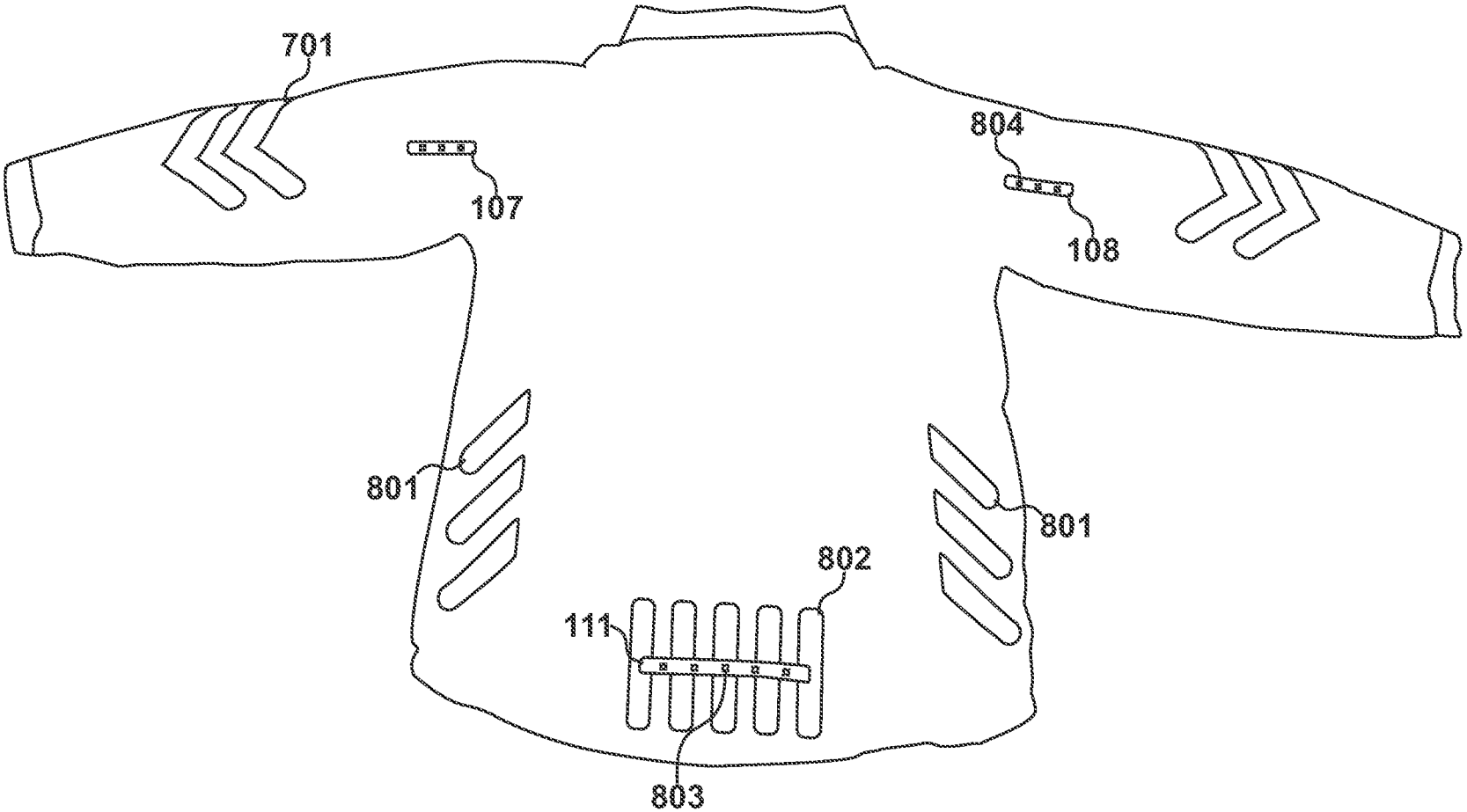
FIG. 8 illustrates items added to the rear of a jacket.

The rear of the jacket shown in FIG. 7 is illustrated in FIG. 8. Rear reflective elements 801 are included to the sides of the jacket and additional reflective elements 802 are included towards the bottom of the jacket. Illuminator 111 is also included towards the bottom of the jacket and comprises, in this example, five LED devices 803 configured to emit red light.

FIG. 8 also illustrates the position of the left rear indicator 107 and the right rear indicator 108. Again, the left rear indicator 107 and the right rear indicator 108 include, in this example, three LED devices 804 configured to emit amber light. Thus, when the left arm is raised, indicator 107 will flash and when the right arm is raised, indicator 108 will flash.

The jacket is an example of a wearable item for enhancing visibility and the invention could be applied to other items, such as a vest, a shirt, a jacket, a glove or a rucksack. Material elements are connected together by stitched seams and at least one illuminating device is provided along with a source of electrical power. A conductor conducts electrical power from the source of electrical power to the illuminating device and a substantial portion of the conductor is secured within the seams.

FIG. 9

Figure 9:
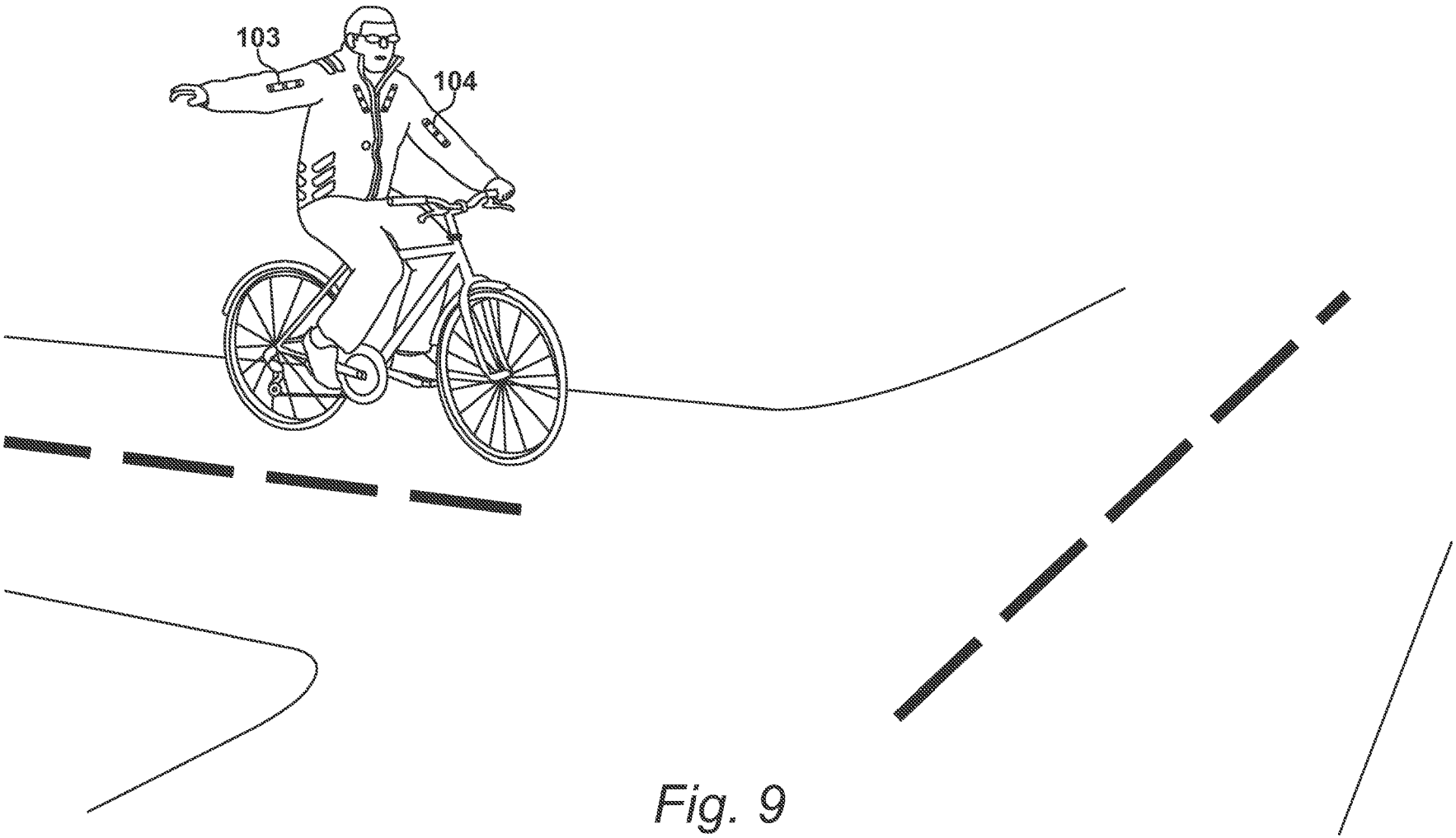
FIG. 9 illustrates an arm being raised.
Figure 10:
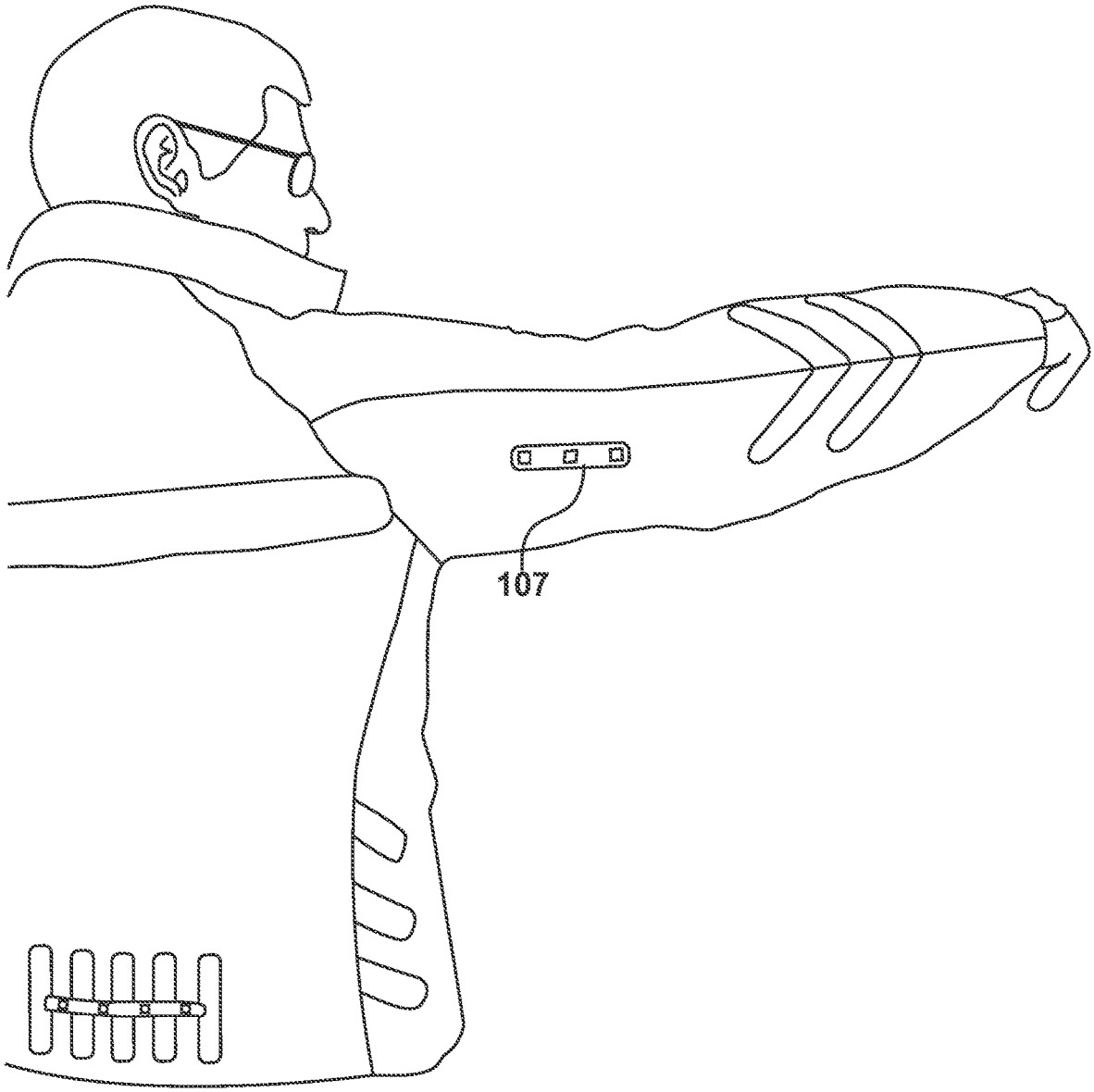
FIG. 10 illustrates an activation of an illumination device in response to an arm being raised.

A jacket for enhancing the visibility of a user is shown, in use, in FIG. 9. Right detection device 101 identifies the raising of a right arm. Right indicator light 103 is configured to indicate in response to identifying the right arm being raised. Similarly, left detection device 102 is configured to identify the raising of the left arm. The left indicator device 104 is configured to indicate in response to identifying the raising of the left arm.

The housing 105 contains the power supply and the control circuit and remains protected, when the jacket is closed, although allowing easy access in order for the device to be energized or de-energized by the activation of toggle button 104.

As described with reference to FIGS. 2 to 5, wires connect the housing to the detection devices and the indicators; and these wires are restrained within seams sewn into the item. As shown in FIG. 9, the item of clothing may, in an embodiment, take the form of a jacket.

In an embodiment, the detection devices 101, 102 include mechanical devices such that each mechanical device is moveable between a first position, as shown by the left arm in FIG. 9, and a second position, when an arm is raised to indicate an intention to turn, as shown by the right arm in FIG. 9.

Thus, in response to the right arm being raised as shown in FIG. 9, indicator 103, comprising a plurality of light emitting diodes, emits light indicating that the cyclist wishes to turn right. To be consistent with accepted practice for motor vehicles, the indicator lights may be amber and may flash periodically.

FIG. 10

As the right arm is raised, indicator 103 will flash amber; in a preferred embodiment, a similar indicator 107 on a rear portion of the arm will also flash. Thus, in this way, the indication can be seen by a motorist approaching the cyclist from the front or approaching the cyclist from behind.

FIG. 11

Figure 11:
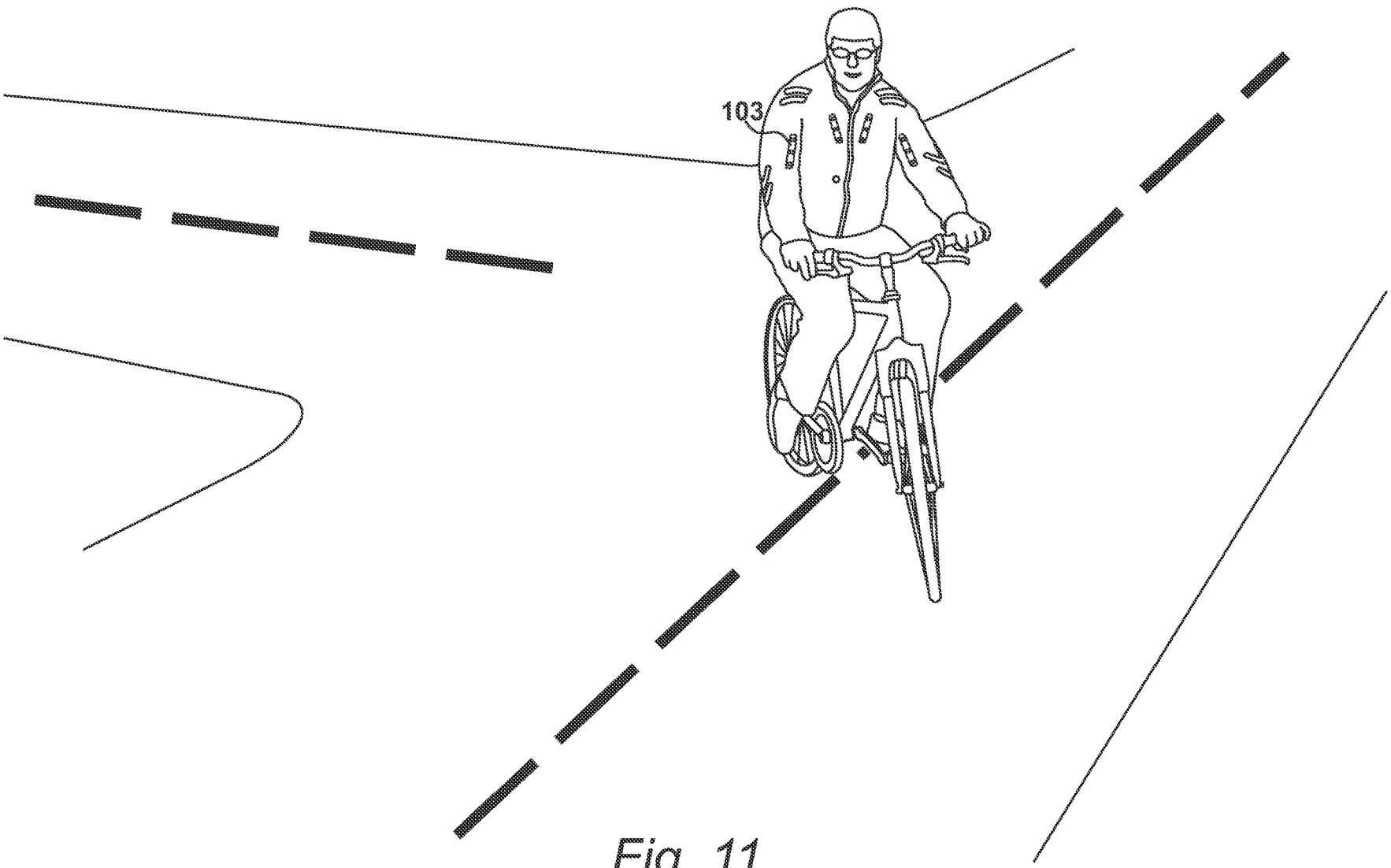
FIG. 11 illustrates continued activation on returning an arm to a control position.

In accordance with accepted practice, a cyclist will raise an arm indicating an intention to turn in the direction of the raised arm. In order to perform the maneuver, the cyclist would usually return their raised arm to the handlebars, as illustrated in FIG. 11. In an embodiment, a delay or monostable circuit is provided such that, for a period of time (possibly ten seconds), indicator 103 continues to flash after the right arm has been returned to the handlebars. Thus, as the cyclist turns, the indicator continues to flash.

Given that it is desirable for this flashing to continue, for the duration of the turn, it is preferable to locate indicator 103 towards the top of the arm in preference to being around the position of the wrist. Thus, while a position at the wrist would be desirable when the arm is extended, as illustrated in FIG. 9, it is preferable for the indicator to be higher up the arm when the hand is returned to the handlebars, as illustrated in FIG. 11. However, in an alternative embodiment, it would be possible to include indicators at both locations.

FIG. 12

Figure 12:
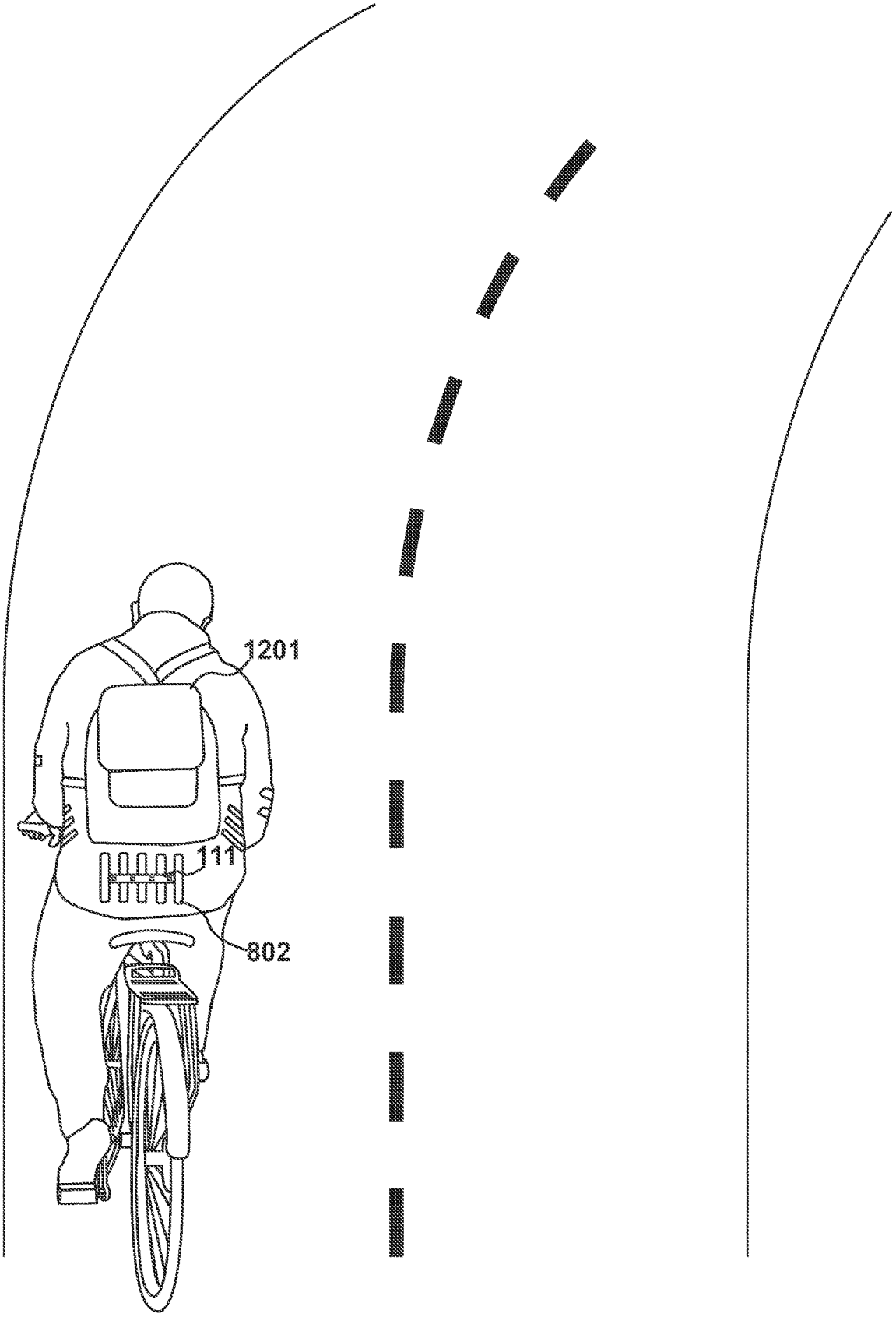
FIG. 12 illustrates reflectors on the rear of the jacket.

As described with reference to FIG. 8, rear reflector 802 and rear illuminator 111 are positioned towards the bottom of the jacket. Again, in some applications, it may be preferable to position indicator 111 higher up, such that its visibility to motorists is optimized. However, in the embodiment of FIG. 12, indicator 111 is positioned towards the bottom of the jacket such that the user may carry a rucksack 1201 or similar item without obscuring indicator 111.

A wearable item has been described for use by cyclists. However, it should be appreciated that other situations may arise for alternative users being provided with a wearable item having at least one illuminating device thereby enhancing the visibility of the user. Thus, wearable items of this type could be used for other sporting activities or other manual activities performed in the vicinity of motor vehicles.

What I claim is:

1. A high visibility jacket, comprising:

a plurality of material elements connected by stitched seams, comprising a plurality of layers including an internal mesh layer and a high visibility fluorescent outer layer;

wherein each of said stitched seams connects an edge of a first material element to an edge of a second material element and several layers of material are formed at the seams, and the seams are a relatively strong region of the jacket and are less susceptible to being strained due to stresses in use of the jacket;

at least one illuminating device disposed on said outer layer external to said layers of material;

an electrical source;

a detection device; and a wiring loom disposed within the jacket, said wiring loom having conductors connected to said electrical source to said at least one illuminating device and to said detection device for conducting electricity from said electrical source to said illuminating device upon activation of said detection device, wherein a substantial portion of an entirety of said wiring loom of the conductors is secured within one or more of said stitched seams between the first material element and second material element and between a first row of stitches and a second row of stitches.

2. The high visibility jacket of claim 1, including a housing for enclosing the electrical source, wherein said housing is removable from the high visibility jacket.

3. The high visibility jacket of claim 2, further comprising water resistant connectors coupled to the conductors in the high visibility jacket, wherein said housing is connectable and detachable from said water resistant connectors.

4. The high visibility jacket of claim 2, including a pocket within said high visibility for restraining said housing.

5. The high visibility jacket of claim 1, wherein said at least one illuminating device is a light emitting diode.

6. The high visibility jacket of claim 5, wherein said at least one illuminating device includes a plurality of light emitting devices configured to emit a first light colour and a second light colour.

7. A method of fabricating a high visibility jacket, comprising the steps of:

constructing an illumination system, comprising an illuminating device; and a detection device;

an electrical source;

a wiring loom having conductors connecting said electrical source to said detection device and to said illuminating device;

assembling material components together, wherein said material components comprise an internal mesh layer and a high visibility fluorescent outer layer which are configured to be joined together by stitched seams connecting an edge of a first material element with an edge of a second material element with a first row of stitches and a second row of stitches;

forming at least one pair of parallel seams with the first row of stitches and the second row of stitches between two adjacent overlapping layers of the material components; and several layers of material are formed at the stitched seams and the stitched seams are a relatively strong region of the jacket and are less susceptible to being strained due to stresses in use of the jacket and;

securing a substantial portion of the entirety of said wiring loom and the conductors within the parallel seams during said assembling step between said first row of stitches and said second row of stitches, disposing said illuminating device of said illumination system on said outer layer external to said layers of material.

8. The method of claim 7, including the step of including additional illuminating components to said illuminating device.

9. The method of claim 7, further comprising the step of connecting said wiring loom to a housing by a de-connectable connector to facilitate the removal of said housing.

10. A high visibility jacket, comprising:

a plurality of material elements connected by stitched seams, defining a plurality of layers including an internal mesh layer and a high visibility fluorescent outer layer, in which each said seam includes a respective first row of stitches and a respective second row of stitches;

at least one illuminating device disposed on said outer layer;

a housing, having an electrical source connected to said at least one illuminating device for energizing said illuminating device;

a detection device connected to said illuminating device;

a wiring loom connected to the housing having conductors for conducting electricity from said electrical source to said illuminating device upon activation of said detection device;

the improvement being in that:

a substantial portion of an entirety of said wiring loom and of said conductors is secured between said first row of stitches and said second row of stitches of at least one respective seam of the plurality of material elements;

at least one of said plurality of material elements provides an internal pocket for receiving said housing; and said housing is connected to said conductors via a detachable plug.

* * * * *